US006736390B2

(12) United States Patent
Chihara

(10) Patent No.: US 6,736,390 B2
(45) Date of Patent: May 18, 2004

(54) SHEET RE-FEED DEVICE AND IMAGE FORMING APPARATUS

(75) Inventor: Hiroshi Chihara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 184 days.

(21) Appl. No.: 09/761,758

(22) Filed: Jan. 18, 2001

(65) Prior Publication Data

US 2001/0011794 A1 Aug. 9, 2001

(30) Foreign Application Priority Data

Jan. 21, 2000 (JP) ..... 2000-012697

(51) Int. Cl.[7] ..... B65H 29/60
(52) U.S. Cl. ..... 271/186; 399/364
(58) Field of Search ..... 271/186; 399/364

(56) References Cited

U.S. PATENT DOCUMENTS 5,703,693 A * 12/1997 Morikawa ..... 358/296
5,893,020 A * 4/1999 Atsumi ..... 399/364
6,226,069 B1 * 5/2001 Tabuchi et al. ..... 355/26
6,320,674 B1 * 11/2001 Soma et al. ..... 271/3.03

* cited by examiner

*Primary Examiner*—Christopher P. Ellis
*Assistant Examiner*—Mark A. Deuble
(74) *Attorney, Agent, or Firm*—Fitzpatrick, Cella, Harper & Scinto

(57) ABSTRACT

An image forming apparatus includes a guide unit for guiding sheets fed by a sheet feed unit to an image forming unit, a discharge guide unit for discharging the sheets onto which images are formed, by the image forming unit, a re-transportation guide unit for branching the sheets from the discharge guide unit and guiding them through the image forming apparatus again, and a plurality of sheet sensors disposed in the re-transportation guide unit at intervals in a sheet transportation direction for determining positions at which the sheets are placed in a standby state, wherein the number of sheets, which are placed in the standby state is selected based on sheet size information so that more sheets are placed in the standby state when a sheet size is short than when it is long. Accordingly, the throughput of short sheets can be increased when images are recorded on both sides thereof.

7 Claims, 4 Drawing Sheets

SHEET RE-FEED DEVICE AND IMAGE FORMING APPARATUS

BACKGROUND OF THE INVENTION

1. Field of the Invention

The present invention relates to an image forming apparatus for recording images on both sides of a sheet by reversing and re-feeding the sheet, and more particularly, to an image forming apparatus for improving throughput of a sheet re-feed device.

2. Description of the Related Art

Hitherto, many image forming apparatuses having an image forming unit for recording an image on one side of a sheet have been proposed. These image forming apparatuses are arranged so as to record images on both sides of the sheet by re-feeding it to the image forming unit after the front and back sides thereof are reversed.

A sheet re-feed device for reversing and re-feeding sheets is typically arranged such that (1) sheets are placed on an intermediate tray while being bent and reversed in a sheet feed direction and then fed again or (2) the leading end and the trailing end of the sheets are changed by being switched back by a reverse unit and then sequentially fed again from a re-feed unit.

In the latter system, the maximum number of sheets exiting on a transportation path (a reverse unit and the re-feed unit) of the sheet re-feed device is set in accordance with a sheet having a maximum length capable of being handled by the sheet re-feed device. When, for example, the maximum number of sheets is two sheets, an image forming apparatus feeds a first sheet to the re-feed unit of the sheet re-feed device and places it in a standby state there and then feeds a second sheet with an interval between it and the first preceding sheet to prevent the first sheet from colliding against the second sheet and places the second sheet in a standby state on the reverse unit of the sheet re-feed device. Subsequently, the first sheet, which was placed in the standby state on the sheet re-feed device, is fed again to an image forming unit where an image is recorded on the back side of the first sheet, and then the first sheet is discharged to an outside of the image forming apparatus. Then, the second sheet, which was placed in the standby state on the reverse unit, is fed to the re-feed unit while a third sheet is transported to and placed in a standby state on the reverse unit. Repetition of the above operations permits images to be continuously recorded on both sides of the first, second, and third sheets.

Recently, when an image is recorded on sheets having a short length by an image forming apparatus, those sheets are fed at short intervals so as to increase the number of sheets processed in a unit time (hereinafter, referred to as "throughput"). However, the number of sheets that can be placed in a standby state on the re-feed unit is set in accordance with a sheet having a maximum length as described above. As such, a problem arises in that the throughput cannot be increased.

To solve this problem, it has been contemplated to make a sheet transportation speed higher in the sheet re-feed device than in the main body of the image forming apparatus. However, the sheet transportation speed in the main body of the image forming apparatus is sufficiently increased by an increase in the throughput of the main body. Thus, it is necessary to increase the size of a transportation motor to transport sheets at a higher speed in the sheet re-feed device, which thereby increases the manufacturing cost of the image forming apparatus.

SUMMARY OF THE INVENTION

Accordingly, it is an object of the present invention to provide a sheet re-feed device capable of increasing the throughput of sheets having a short length without increasing a transportation speed in the sheet re-feed device, and to provide an image forming apparatus on which the sheet re-feed device is mounted.

Further, to solve the above problem, a sheet re-feed device and an image forming apparatus according to the present invention are typically arranged such that the sheet re-feed device, which includes a sheet reverse unit, a re-feed path for guiding sheets, and a re-feed unit disposed downstream of the re-feed path, comprises a plurality of sheet sensing devices and a sheet transportation stop unit for transporting and stopping the sheets, which are disposed in the re-feed path, so that more sheets are placed in a standby state when they are short than when they are long.

As described above, in the sheet re-feed device and the image forming apparatus according to the present invention, more sheets can be placed in the standby state on the transportation path of the sheet re-feed device, which can increase the throughput of short sheets when images are recorded on both the sides thereof.

Further objects, features and advantages of the present invention will become apparent from the following description of the preferred embodiments with reference to the attached drawings.

DESCRIPTION OF THE PREFERRED EMBODIMENTS

Figure 1:
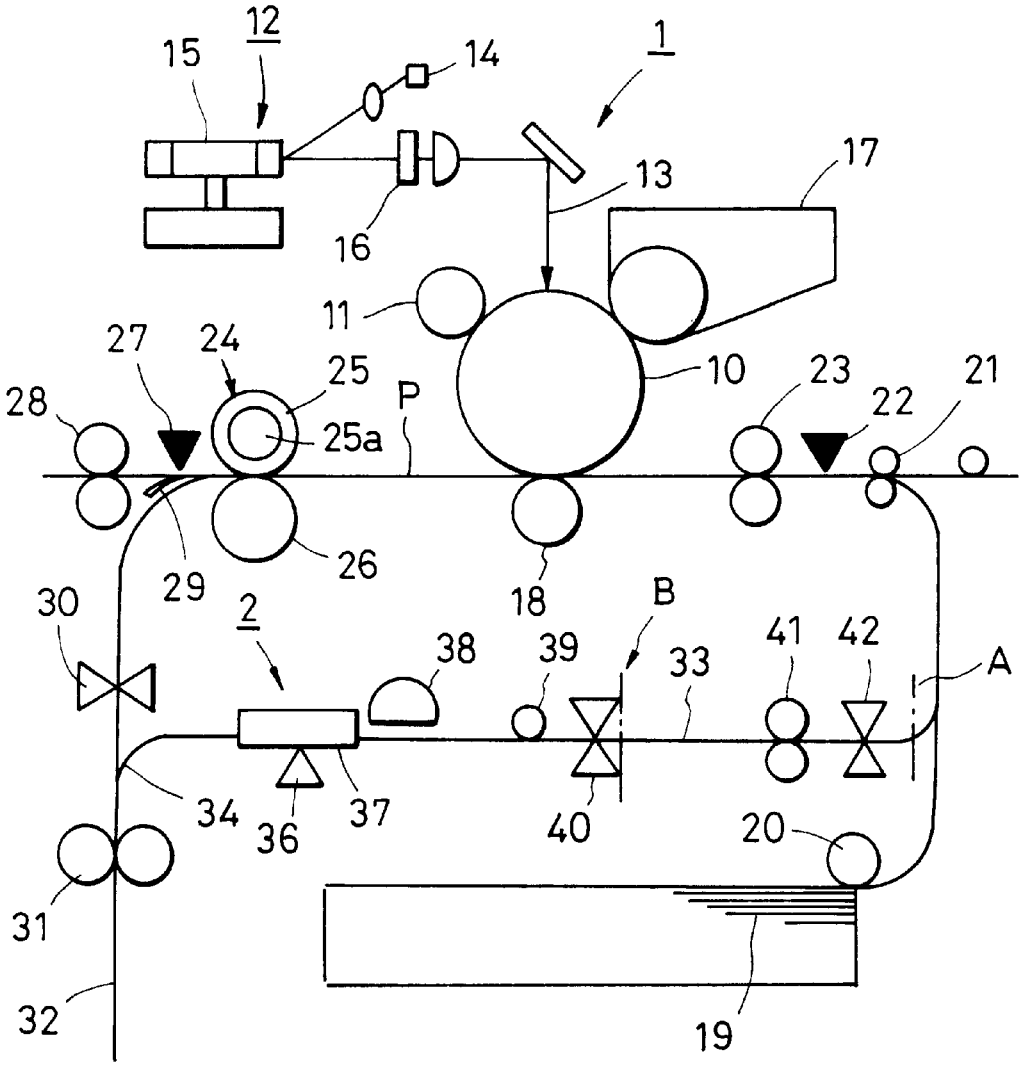
FIG. 1 is a view showing an overall arrangement of an image forming apparatus according to an embodiment of the present invention.
Figure 2:
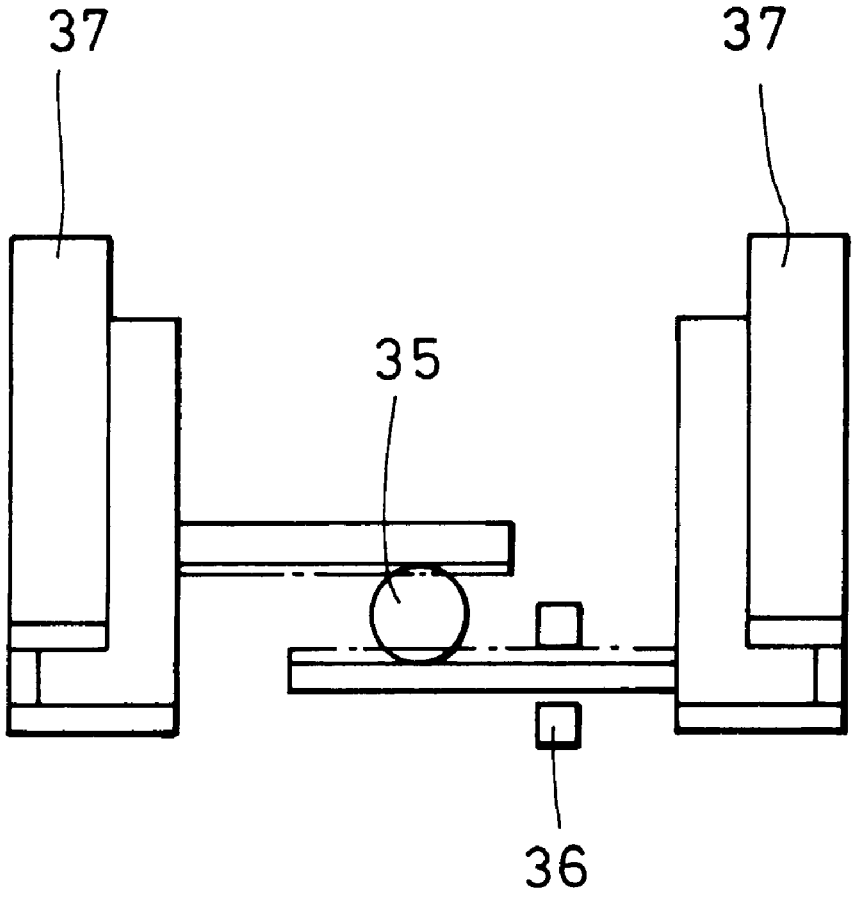
FIG. 2 is a view explaining an alignment mechanism of a sheet re-feed device according to an embodiment of the present invention.
Figure 3:
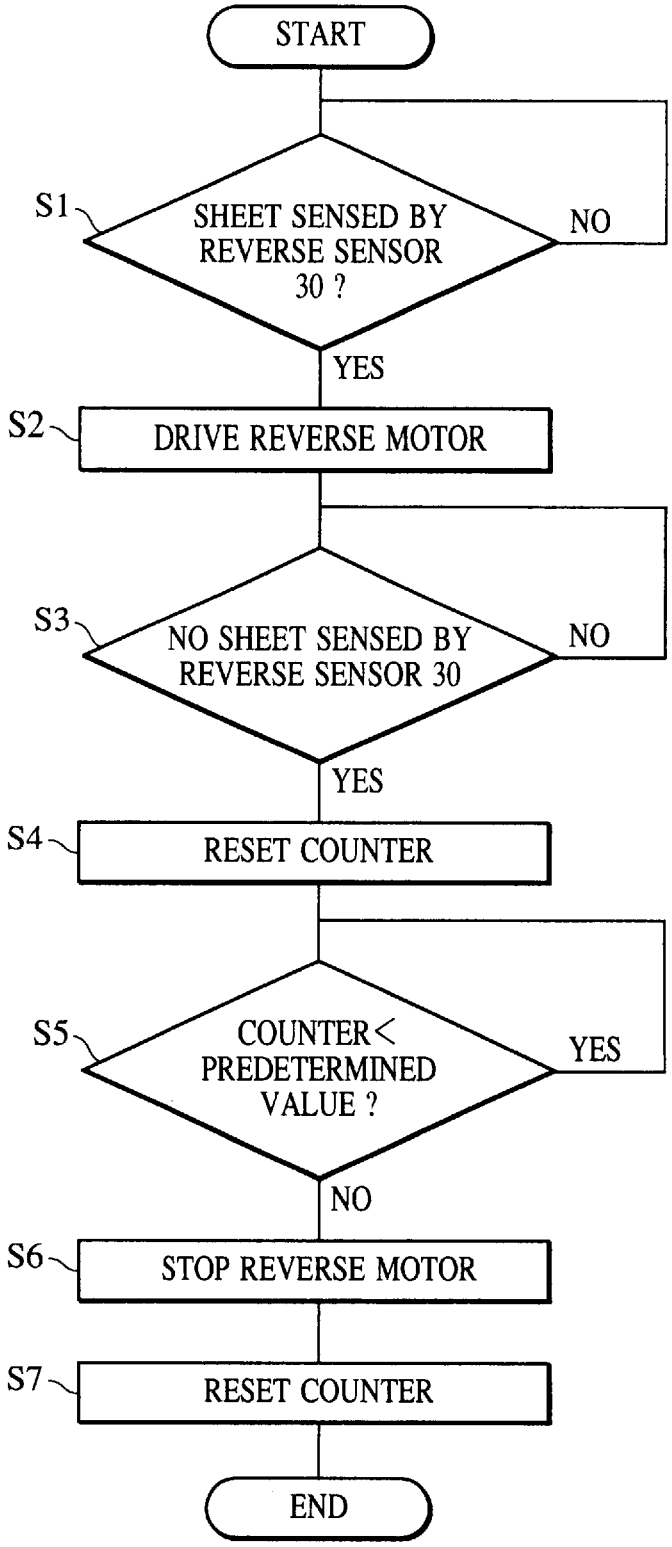
FIG. 3 is a flowchart explaining the operation of the sheet re-feed device.
Figure 4:
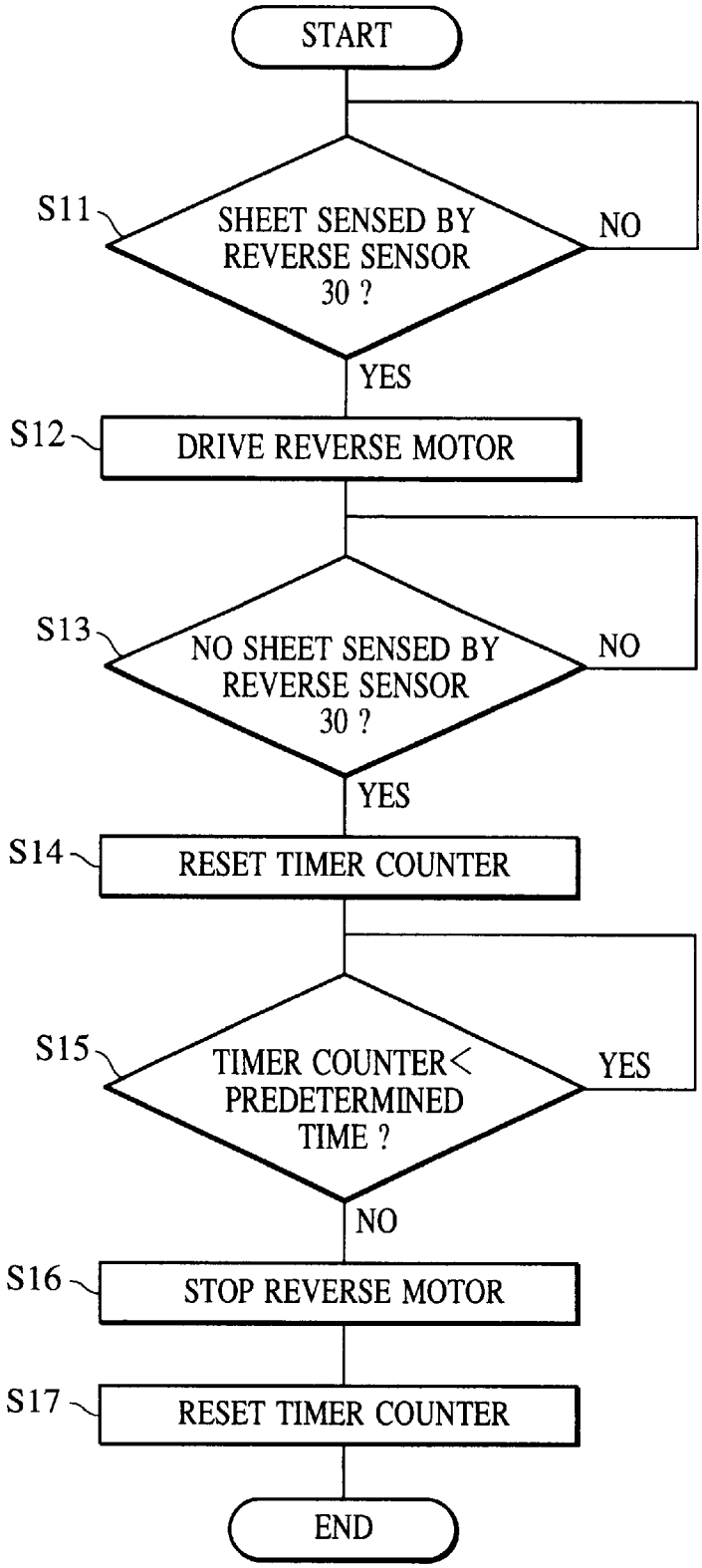
FIG. 4 is a flowchart explaining the operation of a sheet re-feed device according to another embodiment of the present invention.

Embodiments of a sheet re-feed device and an image forming apparatus according to the present invention will be described with reference to the accompanying drawings. FIG. 1 is a view showing an overall arrangement of the image forming apparatus according to an embodiment of the present invention, FIG. 2 is a view explaining an alignment mechanism of a sheet re-feed device according to an embodiment, FIG. 3 is a flowchart explaining the operation of the sheet re-feed device, and FIG. 4 is a flowchart explaining the operation of a sheet re-feed device according to another embodiment. The image forming apparatus shown in FIG. 1 is a laser beam printer employing an electronic photographing system and has the sheet re-feed device 2 in a main body 1 of the apparatus to record images on both sides of a sheet.

(Main Body of Image Forming Apparatus)

A main body 1 of the image forming apparatus includes an image forming device having a photosensitive drum 10 as an image recording unit on which an electrostatic latent image is held, and an electrification roller 11 is, which is abutted against the photosensitive drum 10 from thereabove to uniformly electrify the photosensitive drum 10. A light beam 13 is irradiated downstream of the abutment position of the electrification roller 11 in a rotating direction of the photosensitive drum 10 by an optical unit 12. The optical unit 12 is composed of a semiconductor laser 14 for emitting the light beam 13 based on image data, a scanner 15 for causing the light beam 13 to perform a scan, and an optical lens 16 for converging the light beam 13. Then, the optical unit 12 forms the electrostatic latent image on the surface of the photosensitive drum 10. The electrostatic latent image is transformed into a visible toner image by a development unit 17 disposed further downstream of the position where the light beam 13 is irradiated. The toner image is then transferred onto a sheet P, which acts as a transfer member, by a transfer roller 18 which is abutted against the photosensitive drum 10 thereunder.

Sheets P are placed and accommodated in a sheet cassette 19 at a lower portion of the apparatus and fed therefrom by a hand feed unit (not shown). A feed roller 20 is disposed at an end of the sheet cassette 19 for feeding the sheets P in the sheet cassette 19 to a transportation path. Further, transportation rollers 21, which acts as a sheet transportation mechanism, are disposed downstream of a confluence that is located at a point where the transportation paths of a sheet P fed from the sheet cassette 19 and a sheet P fed from the sheet re-feed device 2 merges, which will be described in detail later. Resist rollers 23 are disposed on the transportation path between the transportation rollers 21 and the transfer roller 18 to correct oblique movement of a sheet P and to synchronize the toner image on the photosensitive drum 10 with a sheet p being fed. Note that a sheet sensor 22 is interposed between the resist rollers 23 and the transportation rollers 21 to sense whether or not a sheet p is present on the transportation path.

The sheet P, onto which the toner image has been transferred, is transported to a fixing unit 24. The fixing unit 24 is composed of a fixing roller 25 containing a heater 25*a* therein and a pressure roller 26 which is in pressure contact with the fixing roller 25. Then, the fixing unit 24 fixes the toner image onto the sheet P by transporting the sheet P between the rollers 25 and 26 where heat and pressure are applied to the sheet P. A discharge sensor 27 is disposed downstream of the fixing unit 24 to confirm that the sheet P has been discharged, and the sheet P is discharged to the outside of the apparatus by discharge rollers 28. Further, a flapper 29 for switching the sheet transportation path is interposed between the discharge sensor 27 and the discharge rollers 28 to switch a mode in which the sheet P is discharged to the outside of the apparatus and a mode in which it is guided to the sheet re-feed device 2.

(Sheet Re-Feed Device)

A sheet P having been guided to the sheet re-feed device 2 is reversed from a front side to a back side by a sheet reverse unit composed of a reverse sensor 30, a pair of reverse rollers 31, and a reverse path 32. The sheet P first passes through the reverse sensor 30 and is transported to the reverse path 32 by the pair of reverse rollers 31. The pair of reverse rollers 31 are stopped once at a predetermined timing at which the trailing end of the sheet P passes through a confluence 34 of the reverse path 32 and a re-feed path 33 after the leading end thereof passes through the pair of reverse rollers 31, and then the drive direction of the pair of reverse rollers 31 is reversed so that the sheet P is switched back. The sheet P having been switched back is transported to the re-feed path 33 from the trailing end thereof based on a nip angle of the pair of reverse rollers 31 and a shape of the confluence 34 and further transported with its front side facing downward. In addition, one of the pair of reverse rollers 31 is arranged so as to be separated from the other of them by a pressure removing solenoid (not shown).

The re-feed path 33 includes a lateral registration motor 35, a lateral registration home position sensor (hereinafter, referred to as lateral registration HP sensor 36), and lateral registration plates 37 as an alignment mechanism for correcting oblique movement of a sheet P and dislocation of the center position thereof on the transportation path as shown in FIG. 2. The lateral registration plates 37 can be opened and closed in a right angle direction with respect to the sheet transportation path by the lateral registration motor 35 and a rack and a pinion. The lateral registration plates 37 are greatly opened when the sheet P is transported thereto and closed in accordance with a sheet width when the sheet P reaches therebetween so as to align the sheet P in the width direction thereof. Note that the lateral registration motor 35 aligns the lateral registration plates 37 with the sheet width by moving them by predetermined steps after the lateral registration HP sensor 36 senses the lateral registration plates 37.

At that time, the sheet P cannot be aligned when it is clamped by feed rollers. Thus, a D-shaped cut roller 38 is used as a transportation roller located downstream of the lateral registration plates 37, and when the sheet P is to be aligned, the D-shaped cut roller 38 is stopped with its cut surface facing the sheet P, thereby releasing the sheet P from the D-shaped cut roller 38 which comes into contact therewith under pressure. Further, when the sheet P is long and also clamped by the pair of reverse rollers 31, one of the rollers is separated from the sheet P by the pressure removing solenoid so as to release the sheet P from the intimate contact therewith.

A transportation roller 39 acting as one of a plurality of sheet transportation stop units, and a two-side sensor 40 acting as one of a plurality of sheet sensors for sensing a sheet P being transported, are disposed to the re-feed path 33, and the sheet P is fed again to the image forming device by re-feed rollers 41, which constitute a re-feed unit as well as one of the sheet transportation stop units. A re-feed standby position A is set forward of a confluence of the re-feed path 33 and the transportation path from the sheet cassette 19, and a re-feed sensor 42 acting as one of the plurality of sheet sensors, is disposed upstream of the re-feed standby position A. The two-side sensor 40 senses the leading or trailing end of the sheet P on the re-feed path 33 so as to obtain sheet size information as well as to control the transportation of the sheet P. A plurality of sheets p are transported on the transportation path while maintaining predetermined intervals therebetween so that one sheet and another sheet do no overlap one another.

When the leading end of the sheet P reaches the re-feed standby position A, a re-feed standby state is transmitted to the main body of the image forming apparatus, and the sheet P waits for a re-feed command. A different re-feed standby position is set for each sheet size. When the sheet P receives the re-feed command from the main body of the apparatus after it has been set to the re-feed wait state, it is re-fed from the sheet re-feed device 2. At that time, the trailing end of each sheet P is controlled and each sheet P is continuously transported until the trailing end thereof passes through the sheet re-feed device 2. Further, when a temporary stop command is issued from the main body of the apparatus, the sheet P obeys the command.

When a sheet size and the length of the transportation path are taken into consideration, if one long sheet is located at the re-feed standby position of the re-feed path 33, another sheet will be placed in a standby state on the reverse path 32, thereby establishing that the maximum number of sheets which can be placed in a standby state on the re-feed path 33 is 2 sheets. However, when sheets are short, one more sheet can be placed in a standby state at a position B on the transportation path 33 with its leading end in coincidence with the two-side sensor 40. Thus, a maximum number of sheets managing unit is disposed to the main body 1 of the apparatus or to the sheet re-feed device 2 to determine how many sheets can be placed in a standby state based on the length of sheets p to be transported. Further, a number of sheets managing unit (composed of sensors 42, 40, 30, and the like) is disposed to the sheet re-feed device 2 to manage the number of sheets that are actually placed in a standby state in the sheet re-feed device 2.

The maximum number of sheets managing unit will be described in detail below.

A sheet size is input as information when an operator selects a cassette through a control panel. Two types of the sensors 40 and 42 are employed in the embodiment, which permits two or three sheets to be placed in a standby state. Therefore, sheet sizes to be used are previously divided into two groups, that is, into a large group and a small group. Then, a table 1 for placing two sheets of the large group in the standby state and a table 2 for placing three sheets of the small group in the standby state are determined, and when sheet information for sheets actually used is inputted, a determination is made whether the sheets belong to any of the tables, and another determination is made whether two sheets are to be placed in the standby state or three sheets are to be placed in the standby state.

Further, the embodiment includes a control unit for transporting the sheets in a predetermined sequence by controlling the sheet transportation unit and the sheet feed unit based on the maximum number of sheets information from the maximum number of sheets managing unit, and on number of sheets on path information from the number of sheets managing unit.

The positions of the leading and trailing ends of respective sheets and the operations of the respective actuators are controlled depending upon how many pulses a stepping motor is driven after the leading or trailing ends of the respective sheets are sensed by the respective sensors. An example of the operation of the sheet re-feed device 2 will be described with reference to the flowchart shown in FIG. 3. A counter used here for description is automatically counted up by one count with respect to one pulse of a reverse motor, acting as a stepping motor for driving the pair of reverse rollers 31, and includes a first system call for referring to the number of counts at present and a second system call for resetting the number of counts to zero.

First, when the leading end of a first sheet P is sensed by the reverse sensor 30 of the sheet re-feed device 2 (step S1), the reverse motor is driven to drive the pair of reverse rollers 31 in a drawing-in direction (step S2) and guides the sheet P to the reverse path 32. When the reverse sensor 30 senses the trailing end of the sheet P (step S3), the counter is reset to zero (step S4). Then, the reverse motor is driven until the counter is set to a predetermined value, which effects a state where the trailing end of the sheet P is held between the pair of reverse rollers 31 with a predetermined amount of the sheet remaining (step S6). Thereafter, the counter is reset to zero again (step S7) and the reverse control is finished.

On completion of the reverse control, the first sheet P is placed in a standby state with its leading end in coincidence with the re-feed standby position A. When the first sheet P is short, a second sheet P is further transported to the sheet re-feed device 2 because the maximum number of sheets managing unit determines that three sheets can be transported thereto as per the maximum set in the present embodiment, and the second sheet P is placed in a standby state with its leading end in coincidence with the two-side sensor 40, and a third sheet P is placed in a standby state on the reverse path 32. At that time, the sheets being transported are stopped and transported again by the transportation roller 39 at the position of the two-side sensor 40 and by the pair of reverse rollers 31 on the reverse path 32.

When the first sheet P is re-fed to the main body 1 from the sheet re-feed device 2 in response to a re-feed command, the number of sheets managing unit transports a fourth sheet P from the sheet cassette 19 to the sheet re-feed device 2 while transporting the remaining sheets p forward one by one so that the maximum permissible number of sheets is placed in a standby state. In the embodiment described above, more sheets are placed in the standby state on the transportation path of the sheet re-feed device 2, which can improve the throughput of short sheets when images are recorded on both the sides of those sheets without increasing a motor cost.

It should be noted that the maximum number of sheets managing unit and the number of sheets managing unit are disposed to the sheet re-feed device 2 in the above embodiment, however, they may be disposed to the main body 1 of the apparatus. When they are disposed to the sheet re-feed device 2, a manufacturing cost can be reduced in an arrangement that does not include the sheet re-feed device 2. Whereas when they are disposed to the main body 1 of the apparatus, an arrangement of the overall image forming apparatus including the sheet re-feed device 2 can be simplified.

(Other Embodiment)

In the description of the above embodiment, a sheet P is transported in accordance with the number of drive pulses of the stepping motor after the leading or trailing end thereof is sensed by the respective sensors. However, it is also possible to transport the sheet in accordance with a period of time during which the stepping motor is driven.

An example of the operation of the sheet re-feed device 2 in the above arrangement will be described with reference to the flowchart shown in FIG. 4. A timer counter used in the description is automatically counted up for the period of time during which the reverse motor is driven and includes a first system call for referring to the number of present counts and a second system call for resetting the number of counts to zero.

First, when the leading end of a sheet P is sensed by the reverse sensor 30 of the sheet re-feed device 2 (step S11), the reverse motor is driven to drive the pair of reverse rollers 31 in a drawing-in direction (step S12) so as to guide the sheet P to the reverse path 32. When the reverse sensor 30 senses the trailing end of the sheet P (step S13), the timer counter is reset to zero. Then, the reverse motor is driven until the timer counter is counted up for a predetermined period of time (step S15), and the reverse motor is stopped in a state where the trailing end of the sheet P is held between the pair of reverse rollers 31 with a predetermined amount thereof remaining (step S16). Then, the timer counter is reset to zero (step S17) again, which thereby finishes the reverse control.

While the present invention has been described with respect to what is currently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

a sheet feed member for feeding sheets;

a guide for guiding the sheets fed by said sheet feed member to an image forming unit for forming an image on the sheet;

a transportation guide for transporting the sheets having an image formed thereon by the image forming unit;

a re-transportation guide for branching the sheets from said transportation guide and for guiding the sheets to said guide to transport the sheet through the image forming unit again; and a plurality of sheet sensing devices disposed in said re-transportation guide at intervals in a sheet transportation direction for determining positions at which the sheets are placed in a standby state, wherein a first sheet sensing device is disposed in a vicinity of a confluence of said guide and said re-transportation guide for sensing a sheet and placing the sheet in the standby state, and a second sheet sensing device is disposed at an interval longer than a small size sheet and upstream of said first sheet sensing device for sensing a sheet and placing the sheet in the standby state, wherein a number of sheets, which are placed in said re-transportation guide in the standby state, is determined based on the sheet size information so that more sheets are placed in the standby state when a sheet size is short than when the sheet size is long.

2. An image forming apparatus according to claim 1, wherein said re-transportation guide comprises a reverse path for switching back sheets branched from said transportation guide and a re-guide path for guiding the sheets from said reverse path to said guide.

3. An image forming apparatus according to claim 2, wherein the number of sheets that can be placed in the standby state on said reverse path and said re-guide path is three.

4. An image forming apparatus according to claim 1, wherein the size of the sheets is divided into a large group and a small groups.

5. An image forming apparatus according to claim 2, wherein said second sheet sensing device is disposed at a midpoint of said re-guide path and said first sheet sensing device is disposed at a point downstream of said re-guide path about said connecting section.

6. An image forming apparatus according to claim 2, wherein the sheets are fed from said sheet feed member and from said re-guide path alternately.

7. An image forming apparatus according to claim 6, wherein a maximum number of standby sheets is selected by a maximum number of sheets managing unit, and, the number of sheets in the standby state is controlled by a number of sheets control means.

* * * * *

UNITED STATES PATENT AND TRADEMARK OFFICE

CERTIFICATE OF CORRECTION

PATENT NO. : 6,736,390 B2
DATED : May 18, 2004
INVENTOR(S) : Hiroshi Chihara

It is certified that error appears in the above-identified patent and that said Letters Patent is hereby corrected as shown below:

Column 3,
Line 1, “roller 11” should read -- roller 11, --; and “is,” should be deleted.
Line 24, “acts” should read -- act --.
Line 28, “merges,” should read -- merge, --.
Lines 33 and 35, “sheet p” should read -- sheet P --.

Column 5,
Line 12, “ sheets p” should read -- sheets P --.
Line 22, “permits” should read -- permit --.
Line 28, “inputted,” should read -- input, --.

Column 6,
Line 16, “sheets p” should read -- sheets P --.

Column 8,
Line 16, “groups.” should read -- group. --.
Line 21, “connecting” should read -- confluence --.
Line 28, “and,” should read -- and --.

Signed and Sealed this

Fourteenth Day of September, 2004

JON W. DUDAS
*Director of the United States Patent and Trademark Office*